United States Patent [19]

Lewis

[11] Patent Number: 4,741,538

[45] Date of Patent: May 3, 1988

[54] METHOD OF PLAYING A WORD FORMING GAME

[76] Inventor: Milton Lewis, 1721 Eager St., Baltimore, Md. 21205

[21] Appl. No.: 859,811

[22] Filed: May 5, 1986

[51] Int. Cl.[4] ..... A63F 3/00

[52] U.S. Cl. ..... 273/243; 273/272; 273/148 A

[58] Field of Search ..... 273/272, 243, 256, 278, 273/148 R, 148 A, 150, 151, 299

[56] References Cited

U.S. PATENT DOCUMENTS

| | | | |
|---|---|---|---|
| 887,464 | 5/1908 | Creasey | 273/243 |
| 2,026,082 | 12/1935 | Darrow | 273/256 |
| 2,602,667 | 7/1952 | Poarch | 273/243 |
| 4,055,347 | 10/1977 | Kreischner | 273/272 X |
| 4,185,833 | 1/1980 | McKee | 273/272 X |
| 4,468,035 | 8/1984 | Slepion | 273/272 |

*Primary Examiner*—Matthew L. Schneider

[57] ABSTRACT

The present invention is of a game which includes the board, cards, playing pieces and the rules for playing the game. The basic principle of the game deals mainly with the purchasing of alphabet letters from an alphabet bank for a predetermined price displayed on the surface of the gameboard. Each player trys to obtain enough alphabet letters to spell out a word while avoiding his opponent's scheme to get his alphabet letters and eliminate his ability to spell out a complete word. Players purchase alphabet letters with play money, and in turn collect a pay-off price for each word. The player that accumulates ten thousand dollars first or eliminates all other players out of the game is the sole winner.

1 Claim, 3 Drawing Sheets

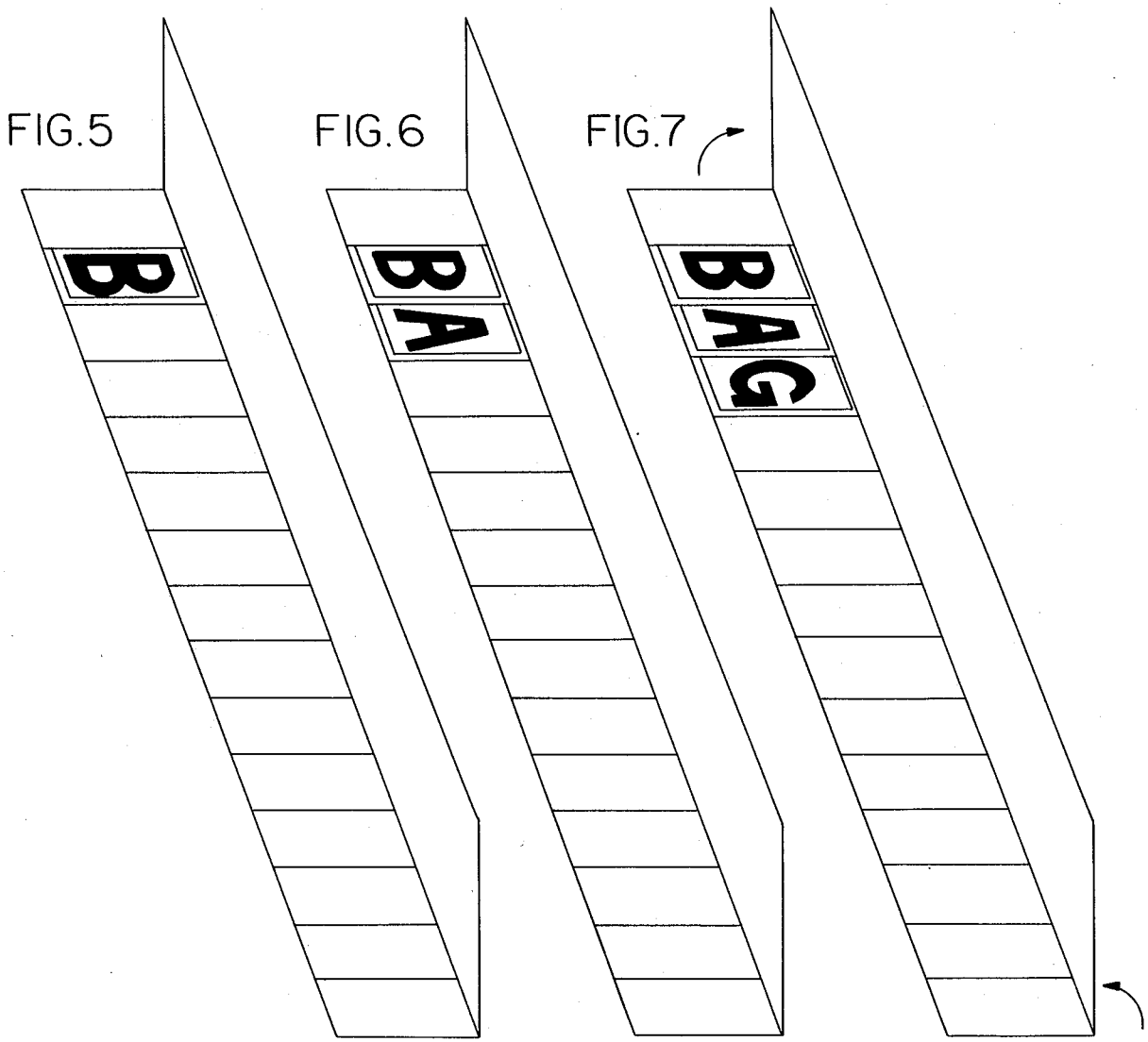
FIG.7
FIG.6
FIG.5
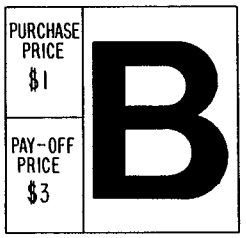
FIG.2
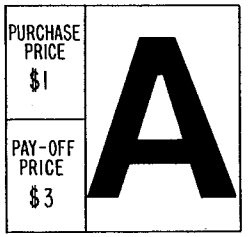
FIG.3
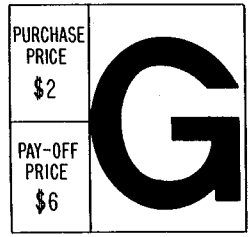
FIG.4

METHOD OF PLAYING A WORD FORMING GAME

BACKGROUND OF THE INVENTION (1) Field of the Invention

The field of invention or field of art to which this invention pertains is the game field, to be more specific board games.

(2) Description of the Prior Art

While most word games require a player to choose blindly from a box of assorted letters, this game displays all twenty-six letters of the alphabet on the main game board giving a player an excellent selection of any letter he needs to spell out a word. This makes the game move alot quicker by avoiding the accumulation of unnecessary letters. While most spelling word games restrict the length of an intended word, this game is unrestricted. Most word games focus the most attention on players forming words, but this game create an interaction between players by allowing them the ability to confiscate another player's letters. Most word games carry too many rules and are far too complicated for most young children. However this game is very adaptable to the young and old simply by increasing the required total of play money needed to be declared winner, or reducing the total, creating a situation in which young children can achieve their required total even though they may be unable to spell the longer words.

SUMMARY

Many games consist of using alphabets and numbers, arranged and displayed on game boards, cards, tiles, blocks, etc. and each game is different in its own way. However none can compare to this game, in which the title shall be known as S-P-E-L-L-O-U-T. The simplicity of the rules is one of the most popular virtues of this game. Children to adults can learn to play this game in less than fifteen minutes and have no difficulty competing against an opponent. All players shall start on their designated starting place. After plucking a card dictating movement, players shall move their playing pieces across the main game area. In this game players have a better chance of acquiring an alphabet letter they want because of the freedom of movement. Because of the unique shape of the hexagons, each of the six sides gives a player six choices of direction, while most games of this type limit movement from one space to another. Players may purchase alphabet letters from the bank for the set price displayed on the main game area. A player also has the option to buy two of the same letters at the same time on one of the two spaces displaying the phrase "Double Letter", thusenabling the player to quickly spell a word. Players can also obtain free alphabet letters by moving into the preoccupied space of another player. The one player shall collect the alphabet letter free of charge from that player thereby saving the expense of buying it from the bank. Using the right strategy a player can spell a complete word while investing a minimum of his own money. While other alphabet games have a player picking blindly from a box of assorted letters this game allows the palyer the opportunity everytime to see exactly which alphabets he will or can obtain. Whenever a player spells a word he knows that if any opponent is residing on an alphabet letter on the game board that is apart of his word he shall collect a pay-off fee. This shall encourage players to spell longer words so that they might be able to catch the maximum amount of opponents as possible. This game is very educational, not only in influencing a player to increase his vocabulary but also in stimulating a player's ability to add, subtract or multiply. Never has there been one game that offered so much pay-off, and educational and entertaining qualities while remaining so simplified.

BRIEF DESCRIPTION OF DRAWINGS

To help better understand the game or invention some drawings are included and below is a brief description of each drawing:

FIGS. 2 to 4 This drawing shows the alphabet cards used to spell out a word.

FIGS. 5 to 7 This drawing shows the stages of progress in the game where enough alphabet letters have been purchased to completely spell out a word.

DESCRIPTION OF THE PREFERRED EMBODIMENT

Figure 1:
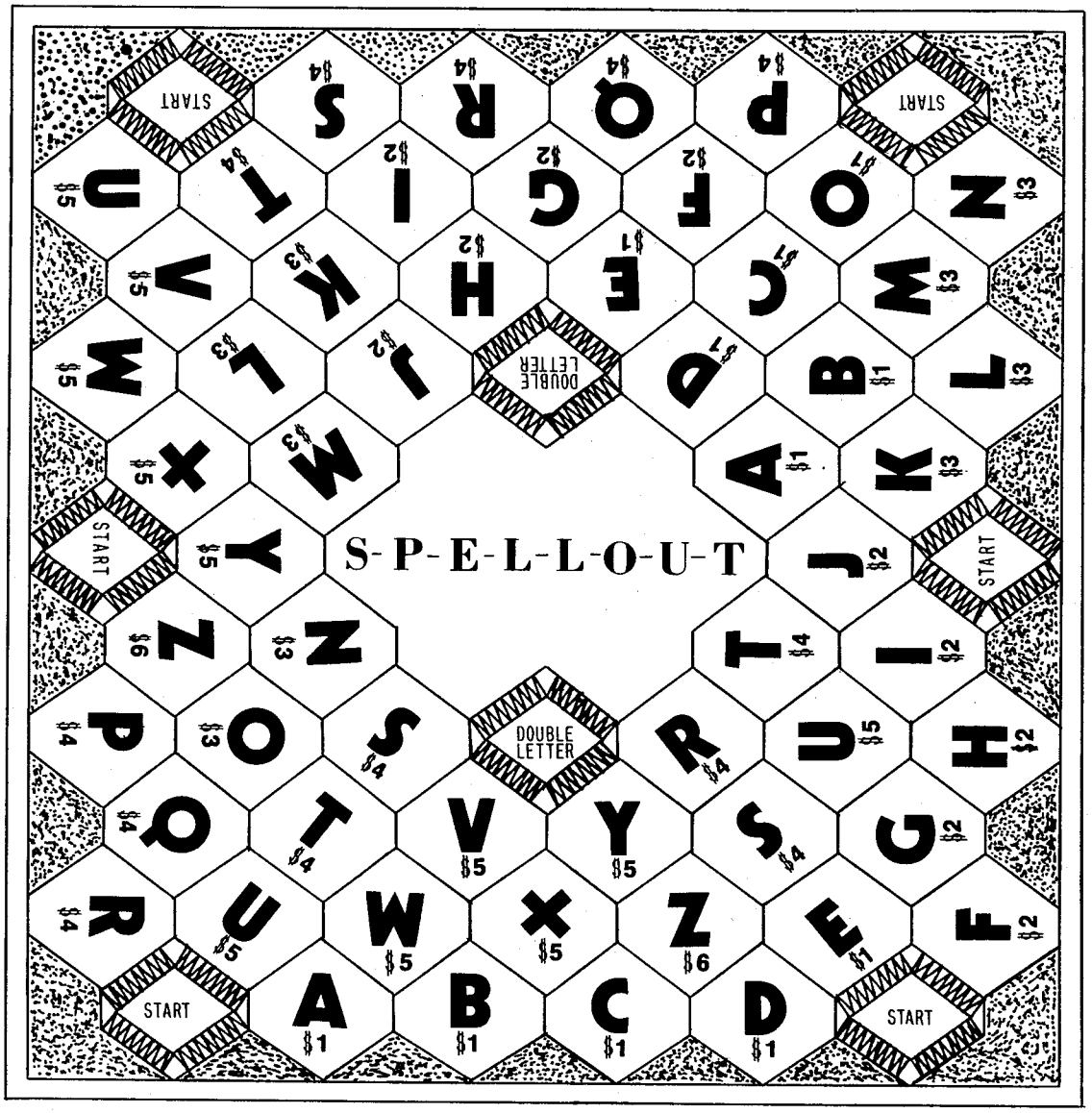
FIG. 1 This drawing shows the planar view of the main game area.
Figure 8:
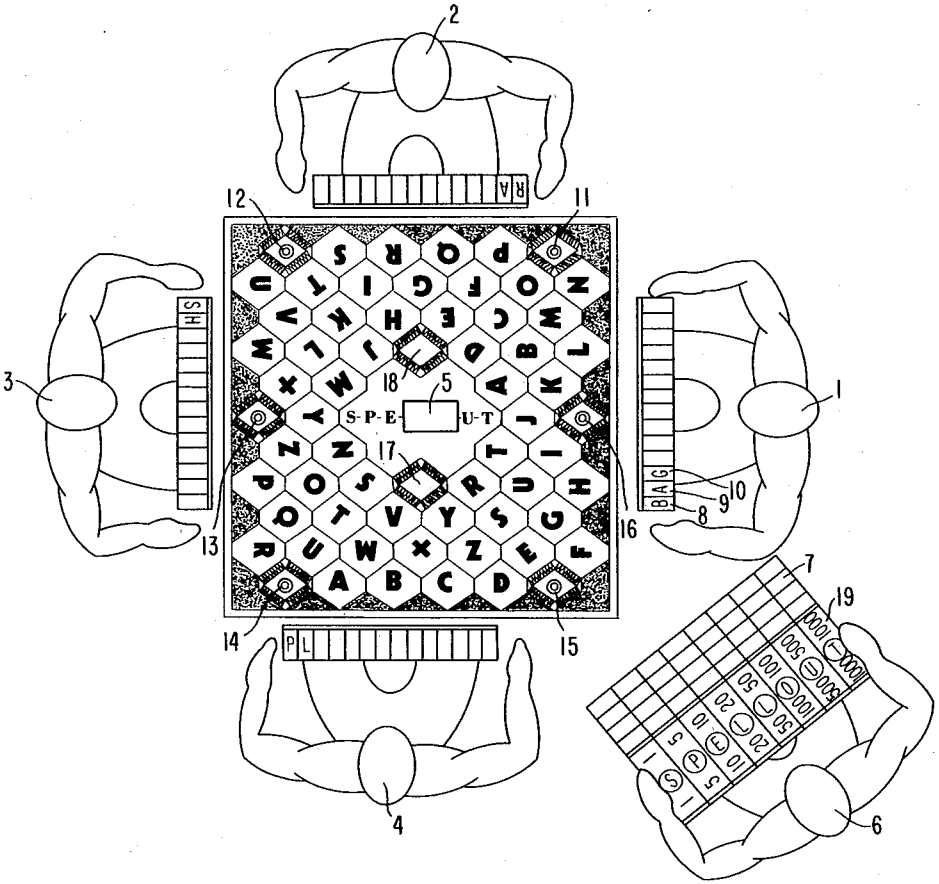
FIG. 8 This drawing shows an overhead plan view of the game being played by four players and a banker.

The following description shall be that of a board game which shall be known as S-P-E-L-L-O-U-t. The apparatus which is used in the game comprises means marked with a game area which denotes a plurality of adjoining identically dimensioned hexagons. This means is in the form of a suitably marked board FIG. 1, which may be foldable. The game area is square in shape and is subdivided into sixty-four adjoining, equally sized hexagons in an arrangement which surrounds the title of the game FIG. 24. Included in the sixty-four hexagons are six hexagons with diamond shapes in the center; No. 8,7,20,21,22,23, located around the perimeter of the game board. There are also two more located at the top and bottom of the title of the game No. 16,17. The first six hexagons No. 8,7,20,21,22,23 are designated for use as a starting place for each player. The color of the hexagon should match the color of the playing piece. However it is not critical of the shape of the playing piece as long as itfits into a hexagon. The other two hexagons are used for double letters No. 16,17. The game can be played by a maximum of six players or a minimum of two. Each player is given a colored playing piece, five hundred dollars of play money and a folding word holder No. 9,18, 31,32,33. which comprises two slabs of cardboard or any suitable material connected together at their longest sides, capable of opening and folding like a pamphlet. When open, it displays a plurality of adjoining slots on the bottom half, inside. There should be at least fourteen of these slots and the slots shall be made parallel to each other vertical position. The folding word holder shall be positioned away from the main game area and conveniently displayed so as to enable only the player to view it and not his opponent.

Also to be included in this game are a plurality of small alphabet cards measuring squarely and matching the size of the folding word holder's slots. No. 13,14,15. Each of the cards is planar and divided on one side into three spaces. The top left-hand space shall display the phrase "purchase price" stating the price a player must pay the bank to obtain that particular alphabet. The bottom left-hand space shall display the phrase "pay-off price" which states the amount of play money that will be paid to that particular player when he has formed a complete work using that alphabet letter. The alphabet letters are purchased from the bank at a set price marked as follows: a-$1, b-$1, c-$1, d-$1, e-$1, f-$2, g-$2, h-$2, i-$2, j-$2, k-$3, l-$3, m-$3, n-$3, O-$3, p-$4, r-$4, s-$4, t-$4, u-$5, v-$5, w-$5, x-$5, y-$5, z-$6. The "pay-off" price is triple the purchase price. In the game played in accordance with the apparatus that has so far been described there are a maximum of six players or a minumum of two who take alternate turns of plucking a card from the deck No. 10. located in the center of the game board. The player then moves his playing piece the amount of spaces as designated on the cards, in any direction he chooses. The alphabet letter that the player lands on must be purchased from the bank at the purchase price. If a player lands on one of the diamonds located at the top and bottom of the game's title No. 16,17, he must purchase two of the same letters at double price. These spaces help a player spell a word more quickly. The cards in this game are simply designed and self-explanatory. There shall be twenty-seven cards altogether and the cards shall display the following phrases: move one space, move two spaces, move three spaces, collect twenty-dollars from all players who cannot show you the letter z, give each player ten dollars if you don't have the letter x, choose an alphabet of your choice then pick an opponent that you believe does not have that alphabet if not be pays you $50, if he does you pay him $50, return marker to start, collect one-hundred dollars from the bank if you have the letter q, "alphabet protector" no one can take any of your letters as long as you have this card. (keep this card) until deck runs out, then it must be reshuffled into the deck, S-P-E-L-L-O-U-T any word you spell is worth twenty times its pay-off price (keep this card until deck runs out then it must be reshuffled into the deck). There shall be one each of the cards that displays a phrase and six each of the cards that display a number making the total number of cards twenty-seven. Returned cards should be placed face up under the deck so that all players would know when the deck should be reshuffled.

The following are some strict game rules that should be followed

1. A dictionary should be used to judge correct spelling.

2. If a player lands into a space and that particular alphabet letter is not available he should pluck another card and move again (repeat as necessary until he obtains an alphabet).

3. Players may sell their alphabet letters back to the bank at a set price of five dollars each, thoughout the game when case is needed to pay a debt only. After the complete spelling of a word, all excess alphabet letters are returned to the bank with no refund.

The object of the game is to be the first player to accumulate ten thousand dollars, or eliminate all other players out of the game. The goal of ten thousand dollars should be reduced to about about five hundred dollars for younger children. All decisions determining the set goal should be decided before the game starts. The more intelligent the players the higher the set goal.

I claim the following:

1. A method of playing a board game wherein the board game is comprised of a game board, a plurality of playing pieces, a bank including play money, a plurality of chance cards and a plurality of alphabet cards, said alphabet cards having indicia thereon designating various letters of the alphabet, said cards also having indicia thereon designating a pay-off price, said game board having a plurality of contiguous spaces thereon, some of said spaces having indicia thereon designating various letters of the alphabet and also having indicia thereon designating a purchase price, the method of play comprising the steps of:

(A) Each player choosing a playing piece and placing the chosen piece on one of said spaces;

(B) A first one of said players picking up one of said chance cards and moving the appropriate playing piece from one space to another on the board according to the directions given on the chosen chance card;

(C) Said first player deciding whether to purchase a letter of the alphabet that corresponds to the letter of the alphabet designated on the space on which the first player's playing piece landed;

(D) Paying an amount of play money equal to the purchase price designated on the space landed on when the player decides to purchase the letter;

(E) Said first player receiving one of said alphabet cards that has a letter of the alphabet thereon that corresponds to the letter just purchased;

(F) Repeating steps B–E by all other players so as to define an order of play and thereafter, continuing to follow steps B–E by each of the players according to the order of play;

(G) Purchasing and collecting said alphabet cards by each of said players in an attempt to form words comprised of the alphabet letters on said alphabet cards;

(H) Any player, after having formed a word, receiving from the bank an amount of play money equal to the total sum of the pay-off price indicia on the alphabet cards that constitute the formed word and receiving the same amount of play money from those other players whose playing pieces are located on a game board space having an alphabet letter thereon that corresponds to one of the alphabet letters constituting the formed word.

* * * * *